US007348733B2

(12) United States Patent
Muramatsu et al.

(10) Patent No.: US 7,348,733 B2
(45) Date of Patent: Mar. 25, 2008

(54) DISCHARGE LAMP LIGHTING CIRCUIT AND METHOD

(75) Inventors: Takao Muramatsu, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 310 days.

(21) Appl. No.: 11/217,178

(22) Filed: Aug. 31, 2005

(65) Prior Publication Data

US 2006/0055344 A1 Mar. 16, 2006

(30) Foreign Application Priority Data

Sep. 1, 2004 (JP) ..... P.2004-254465

(51) Int. Cl.
*H05B 37/02* (2006.01)

(52) U.S. Cl. ..... 315/219; 315/224; 315/307; 315/DIG. 5

(58) Field of Classification Search ..... 315/307, 315/219, 224, DIG. 5, DIG. 7
See application file for complete search history.

(56) References Cited

U.S. PATENT DOCUMENTS 6,580,229 B2 * 6/2003 Murakami et al. ..... 315/224
6,784,626 B2 * 8/2004 Otake et al. ..... 315/291
6,963,178 B1 * 11/2005 Lev et al. ..... 315/307

FOREIGN PATENT DOCUMENTS

JP 07-142182 6/1995
JP 07-169584 7/1995

* cited by examiner

*Primary Examiner*—David H. Vu
(74) *Attorney, Agent, or Firm*—Fish & Richardson P.C.

(57) ABSTRACT

In a lighting circuit for a discharge lamp, the discharge lamp is kept lit without fail when a DC input voltage becomes low, while avoiding a complicated circuit configuration and control method. A DC-AC converter circuit receives a DC input voltage and converts it to an AC voltage and boosts the AC voltage. The DC-AC converter circuit is controlled by a control means having a circuit for detecting the DC input voltage "+B" to perform a lighting control of the discharge lamp. The lighting circuit comprises a transformer for AC conversion, switching elements, and resonance capacitor. The switching elements are driven to cause a series resonance of the resonance capacitor and an inductance component of the transformer for AC conversion or an inductance element. Upon detection of a reduction in the DC input voltage, the switching element driving frequency is shifted to a frequency lower than a frequency range when the discharge light is lit to increase the output voltage of the DC-AC converter circuit, thus maintaining the lighting state of the discharge lamp.

7 Claims, 13 Drawing Sheets

DISCHARGE LAMP LIGHTING CIRCUIT AND METHOD

TECHNICAL FIELD

The present disclosure relates to techniques for ensuring that a discharge lamp is kept lit when a DC power supply provides a low input voltage in a discharge lamp lighting circuit and method suitable for the trend of increasing the frequency.

BACKGROUND

Known lighting circuits for a discharge lamp such as a metal halide lamp include a DC power supply circuit based on a DC-DC converter configuration, and a configuration including a DC-AC converter circuit and a starter circuit. For example, a DC input voltage from a battery is converted to a desired voltage in a DC power supply circuit, and the resulting DC voltage is then converted to an AC output by a subsequent DC-AC converter circuit. A high-voltage signal for starting is multiplexed on the AC output, and the resulting multiplexed signal is supplied to a discharge lamp (see, e.g., JP-A-7-142182).

In a configuration which converts a voltage at two stages (DC-DC voltage conversion and DC-AC voltage conversion), a larger circuit scale is unsuitable for a reduction size, so that a discharge lamp is supplied with an output which is boosted through a single-stage voltage conversion performed in a DC-AC converter circuit (see, e.g., JP-A-7-169584).

Then, a driving control (for controlling the frequency of a switching element) associated with the DC-AC converter circuit is conducted to control a non-load output voltage (hereinafter called "OCV) before the discharge lamp is lit (during extinction), to bring the discharge light toward a steady lighting state, while reducing transient power applied thereto, after the discharge light is turned on by applying a starting signal thereto.

Such conventional lighting circuits may be susceptible to extinction as a result of reduced maximally available power caused by an excessively reduced input voltage from the DC power supply. To prevent such a problem, complicated control components may be required.

For example, measures are required for the extinction of a discharge lamp used as a car illumination light source as a result of a shortage of the power supplied to the discharge lamp when the battery voltage becomes lower. Specifically, while the power supplied to the discharge lamp may be interrupted when the battery voltage is reduced to a predetermined threshold or lower, it is desirable to maintain the discharge lamp in the lighting state, in order to ensure the safety in a night run, by controlling the power supplied to the discharge lamp as long as the discharge lamp can be kept lit.

In a configuration which controls output power for a lighting circuit by controlling a switching frequency in a converter circuit, the power is controlled by setting the switching frequency (or a lighting frequency) to a predetermined frequency or higher such that the discharge light is supplied with substantially constant power in a normal stable lighting state. Here, the "predetermined frequency" means a driving frequency at which the output voltage or output power is maximized when the discharge lamp is lit (this frequency is labeled "f2").

As the capabilities of the lighting circuit are degraded by a reduced DC input voltage to output a lower voltage, the frequency is controlled to provide constant power by bringing the lighting frequency closer to the aforementioned f2.

However, if the DC input voltage is suddenly reduced for some reason, the discharge lamp cannot be kept lit unless sufficient power is outputted to the discharge lamp, even if the lighting frequency is set to f2, resulting in a higher probability of a failure in lighting (i.e., measures must be taken for compensating for a shortage of power).

It is, therefore, desirable to ensure that the discharge lamp is kept lit even when a DC input voltage is reduced without requiring a complicated circuit configuration or control method.

SUMMARY

In one aspect, a lighting circuit for a discharge lamp according to the invention may include a DC-AC converter circuit which receives a DC input voltage to convert the DC input voltage to an AC voltage and boost the AC voltage, a starter circuit for supplying the discharge lamp with a starting signal, and control means having an input voltage detector circuit for detecting the DC input voltage for controlling power outputted by the DC-AC converter circuit to perform a lighting control of the discharge lamp (control of the power applied to the discharge lamp). The lighting circuit for the discharge lamp may include the following configurations.

The DC-AC converter circuit may include a transformer, a plurality of switching elements, and a resonance capacitor, wherein the switching elements are driven by the control means, the DC-AC converter circuit utilizes a series resonance of the resonance capacitor with an inductance component of the transformer or an inductance element connected to the resonance capacitor.

When the input voltage detector circuit detects a DC input voltage equal to or lower than a predefined threshold, a driving frequency for the switching elements is shifted to a frequency lower than a frequency range when the discharge lamp is turned on to increase a voltage which can be outputted by the DC-AC converter circuit to maintain the lighting state of the discharge lamp.

In another aspect, a method includes performing DC-AC conversion using a transformer, a plurality of switching elements, and a resonance capacitor, and driving the switching elements to produce a series resonance of the resonance capacitor with an inductance component of the transformer or an inductance element connected to the resonance capacitor. Upon detection of a DC input voltage equal to or lower than a predefined threshold, a lighting frequency of the discharge lamp is shifted to a frequency lower than a frequency range when the discharge lamp is lit to maintain the lighting state of the discharge lamp.

Thus, the disclosed techniques may increase the output voltage to maintain the lighting state of the discharge lamp when the discharge lamp is about to extinguish due to a reduction in the DC input voltage.

By controlling the driving frequency of the switching elements, the discharge lamp is kept lit even when the DC input voltage becomes lower, without requiring a complicated circuit configuration or control method. Thus, the invention may be advantageous in reducing the size and cost of the circuit apparatus.

The driving frequency for the switching elements is designated "f2" when a maximum output voltage or maximum output power can be generated while the discharge lamp is lit. The threshold associated with the DC input voltage preferably is set to a value higher than the DC input voltage value at which the discharge lamp cannot be kept lit at f2. Specifically, the discharge lamp can be kept lit without fail by reducing the driving frequency for the switching elements before a reduced DC input voltage causes a shortage of the power supplied to the discharge lamp such that the discharge lamp cannot be kept lit.

When the DC input voltage becomes lower, the voltage which can be generated by the DC-AC converter circuit preferably is defined to be equal to or higher than a maximum output voltage at which the discharge lamp is lit. Specifically, assuming that frequencies determined by intersection points of a resonance curve associated with an output voltage applied to the discharge lamp during extinction before the discharge lamp is lit with the maximum output voltage at which the discharge lamp is lit are designated as a first and a second frequency, respectively, wherein the second frequency is higher than the first frequency. When the DC input voltage is equal to or lower than the predefined threshold, the driving frequency for the switching elements is shifted to a frequency range equal to or higher than the first frequency and equal to or lower than the second frequency. In this way, when the discharge lamp accidentally goes out, the control transitions to a resonance curve during extinction, causing the output voltage to increase to the maximum output voltage or higher during the lighting, so that the discharge lamp immediately starts lighting and maintains the lighting state.

To simplify the control configuration, when the driving frequency for the switching elements is shifted to a frequency lower than the frequency range while the discharge lamp is lit in response to the DC input voltage falling to the predefined threshold or lower, the frequency is preferably set within a frequency range defined before the discharge lamp is lit. In other words, it is possible to utilize the driving frequency control before the discharge lamp is lit, thus eliminating the need for designing a dedicated circuit for a reduction in the DC input voltage.

Further, setting the frequency to a fixed value within the frequency range equal to or higher than the first frequency and equal to or lower than the second frequency, or to a fixed value within the frequency range defined before the discharge lamp is lit, when the DC input voltage becomes lower, may be advantageous for simplifying the circuit configuration reducing the cost.

Other features and advantages will be readily apparent from the following detailed description, the accompanying drawings and the claims.

BRIEF DESCRIPTION OF THE DRAWINGS

FIG. 5 illustrates an example of a configuration of a control means.

DETAILED DESCRIPTION

Figure 1:
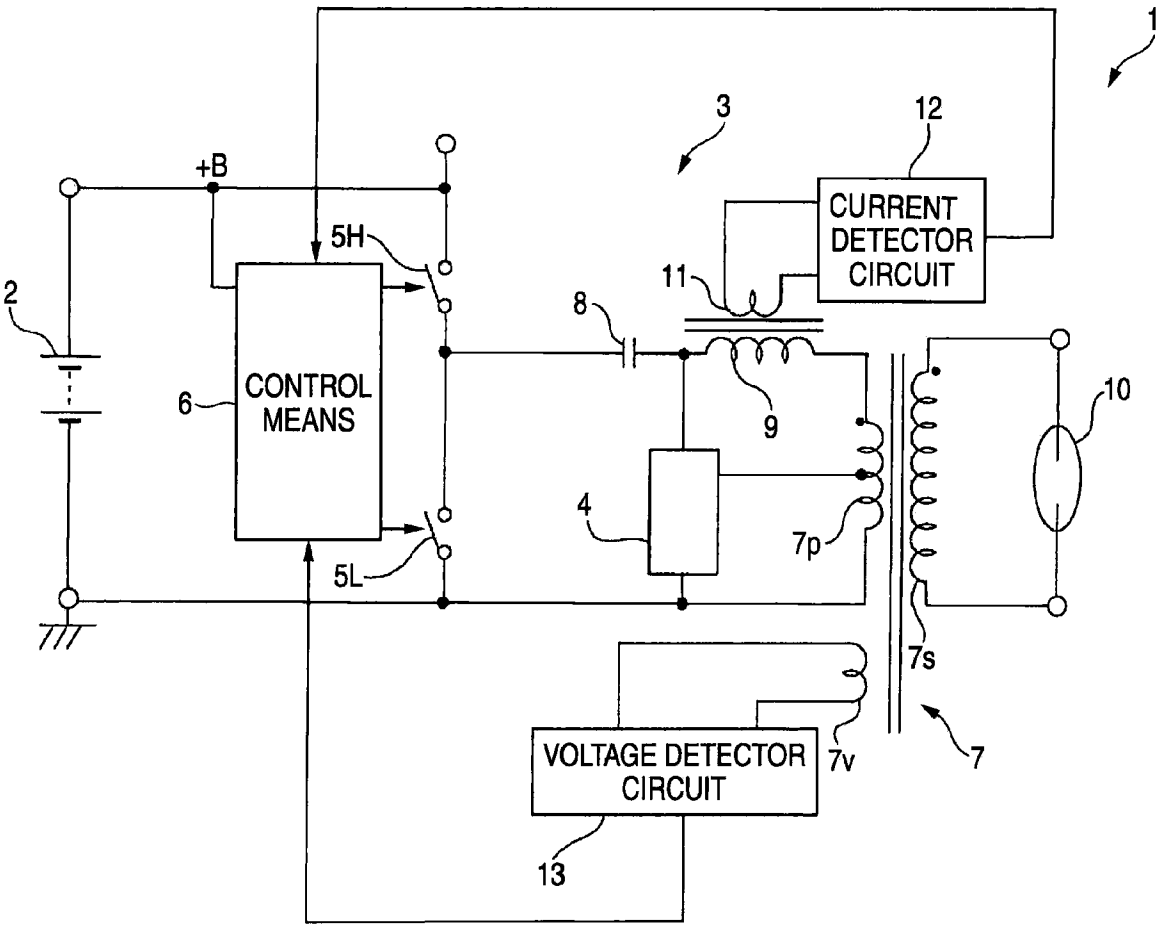
[FIG. 1] A diagram illustrating an example of a basic configuration according to the invention.

FIG. 1 illustrates an example of a configuration according to the invention, where a discharge lamp lighting circuit 1 comprises a DC-AC converter circuit 3 which receives power supplied from a DC power supply 2, and a starter circuit 4.

The DC-AC converter circuit 3 receives a DC input voltage (see "+B" in FIG. 1) from the DC power supply 2, converts the received DC input voltage to an AC voltage, and boosts the AC voltage. In this embodiment, the DC-AC converter circuit 3 comprises two switching elements 5H, 5L, and a control means 6 for controlling the driving of the switching elements 5H, 5L. Specifically, the switching element 5H on the higher stage side has one end connected to a power supply terminal, and the other end grounded through the switching element 5L on the lower stage side. The switching elements 5H, 5L are alternately turned on/off by the control means 6. For simplicity, the switching elements 5H, 5L are represented by symbols of switches in FIG. 1, but semiconductor switching elements, such as field effect transistors (FET), bipolar transistors, and the like may be used.

The DC-AC converter circuit 3 includes a power conversion transformer 7 that utilizes a resonance phenomenon of a resonance capacitor 8 and an inductor or an inductance component on the primary side of the transformer 7. Specifically, the following three arrangements may be used:

(I) an arrangement which utilizes the resonance of the resonance capacitor 8 and inductance element;

(II) an arrangement which utilizes the resonance of the resonance capacitor 8 and a leakage inductance of the transformer 7; and (III) an arrangement which utilizes the resonance of the resonance capacitor 8, an inductance element, and leakage inductance of the transformer 7.

In option (1), an inductance element 9 such as a resonance coil is added with one end of the inductance element 9 connected to the resonance capacitor 8 which is connected to a connection of the switching elements 5H, 5L. The other end of the inductance element 9 is connected to a primary winding 7*p* of the transformer 7.

In option (II), the addition of a resonance coil and the like is not needed because an inductance component of the transformer 7 is utilized. Specifically, the resonance capacitor 8 may have one end connected to the connection of the switching elements 5H, 5L, and the other end connected to the primary winding 7*p* of the transformer 7.

Option (III) can utilize a serially combined reactance of the inductance element 9 and leakage inductance.

In any of the foregoing arrangements, by utilizing a series resonance of the resonance capacitor 8 and inductive element (inductance component or inductance element), the switching elements 5H, 5L are alternately turned on/off with their driving frequency set at a value equal to or higher than the series resonance frequency, allowing a discharge lamp 10 (metal halide lamp or the like) connected to a secondary winding 7*s* of the transformer 7 to operate in a sinusoidal form. In the driving control for each switching element by the control means 6, the respective elements should be reciprocally driven to prevent both the switching elements from turning on simultaneously (by an on-duty control or the like). As to the series resonance frequency, the resonance frequency ("f1") before lighting is in the aforementioned arrangement (III) is expressed by $f1=1/(2\cdot\pi\cdot\sqrt{(Cr\cdot(Lr+Lp1))})$, where "Cr" represents the static capacitance of the resonance capacitor; "Lr" represents the inductance of the inductance element 9; and "Lp1" represents the inductance on the primary side of the transformer 7. For example, a driving frequency lower than f1 causes a large loss of the switching elements and a corresponding reduction in efficiency, so that the switching operation is performed in a frequency range higher than f1. The resonance frequency ("f2") after the discharge lamp is lit, is expressed by $f2=1/(2\cdot\pi\cdot\sqrt{(Cr\cdot Lr)})$ where ($f1<f2$). In this case, the switching operation is performed in a frequency range higher than f2 as well.

The starter circuit 4 supplies a starting signal to the discharge lamp 10. Upon starting, an output voltage of the starter circuit 4 is boosted by the transformer 7 before it is applied to the discharge lamp 10 (the starting signal multiplexed on the output converted to an AC is supplied to the discharge lamp 10). In this embodiment, one of the output terminals of the starter circuit 4 is connected at a halfway location of the primary winding 7*p* of the transformer 7, and the other output terminal connected to one end (ground terminal) of the primary winding 7*p*. An input voltage to the starter circuit may be taken from the secondary side of the transformer 7, or an auxiliary winding (winding 11, described below) may be provided to make up the transformer together with the inductance element 9 to draw an input voltage to the starter circuit from the auxiliary winding.

When the switching elements 5H, 5L are driven in a frequency region lower than the resonance frequency f1 during extinction before the discharge light 10 is turned on, to apply OCV to the discharge lamp, an increasing switching loss may cause reduction in circuit efficiency. A like increase in the loss may occur when the switching elements are driven in a frequency region exceeding f1. It is, therefore, desirable to restrict the duration in which the circuit is continuously operated in a non-load condition so that it no longer than necessary.

After the discharge lamp 10 turns on, the impedance of the resonance circuit becomes capacitive in a lighting state in which the switching elements are driven in a frequency region lower than f2, resulting in an increased switching loss, and a lower circuit efficiency. Therefore, the switching elements preferably are driven in a higher frequency region than f2 after the discharge lamp has been turned on.

Preferably, OCV is controlled with a frequency value near f1 in a discharge lamp extinction state (non-load state) after the power supply is applied to the lighting circuit, and the lighting is controlled in a frequency region higher than f2 when the discharge lamp is transitioned to the lighting state after the generation of the starting signal and the starting of the discharge lamp triggered by the starting signal. In regard to OCV, switching control is performed such that the switching element driving frequency initially is defined at a frequency value biased from f1 and is gradually brought closer to f1. In other words, during extinction before the discharge light is turned on, a method of changing the value of the driving frequency to a target value of OCV from a high frequency side of a resonance curve which has a peak output voltage at f1, for example, is preferable from a viewpoint of the safety and reliability of the circuit in view of the fact that a higher output voltage is supplied to the discharge lamp as the frequency is closer to the resonance frequency f1.

Figure 2:
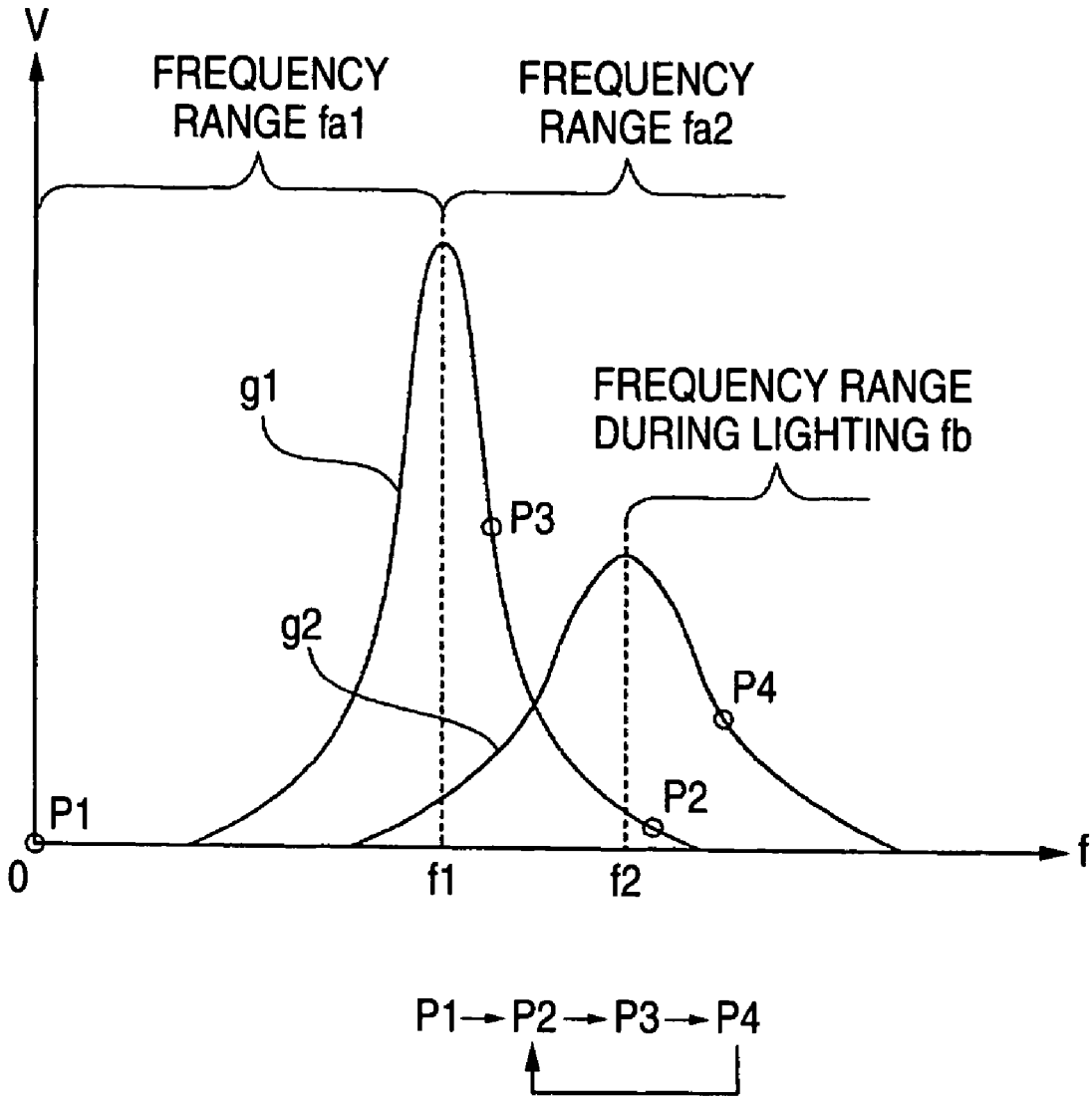
[FIG. 2] A diagram for explaining a control form.

FIG. 2 is a general graphic representation for explaining the control form. The horizontal axis represents the frequency "f," and the vertical axis represents the output voltage "V." The graph shows a resonance curve "g1" when the discharge lamp is extinguished, and a resonance curve "g2" when the discharge lamp is lit. The output power characteristic exhibits a curve having a peak at f2, as is the case with g2, when the discharge lamp is lit.

While the discharge lamp is extinguished, the secondary side of the transformer 7 has a higher impedance, and the primary side of the transformer 7 has a high inductance value, resulting in the resonance curve g1 with the resonance frequency at f1. Also, while the discharge lamp is lit, the secondary side of the transformer 7 has a low impedance (on the order of several tens to several hundreds of ohm) and the primary side of the transformer 7 has a lower inductance value, resulting in the resonance curve g2 with the resonance frequency at f2. (The voltage presents a relatively small amount of change, whereas the currently mainly presents large variations.)

Reference letters shown in the graph represent the following items:

"fa1"=Frequency Range of "f<f1";

"fa2"=Frequency Range of "f>f1";

"fb"=Frequency Range of "f>f2" (during lighting);

"P1"=Operating Point before Application of Power Supply;

"P2"=Initial Operating Point immediately after Application of Power Supply (within the region fb);

"P3"=Operating Point indicative of an Arrival Timing to Target Value of OCV upon extinction; and "P4"=Operating Point after Lighting (within the region fb).

In this embodiment, immediately after the power supply is applied, or immediately after the discharge lamp is once lit and extinguished, the frequency is shifted to the frequency region fb which is higher than the resonance frequency f2 at which the discharge lamp is lit (P1->P2). In other words, the frequency temporarily is increased and then gradually reduced toward f1 (P2->P3), and the frequency is again increased to the frequency region fb once the discharge lamp is lit (P3->P4).

The discharge lamp lighting shift control is conducted in accordance with a procedure which involves generating a starting signal to the discharge lamp subsequent to the OCV control, and lighting the discharge lamp by applying the starting signal. In this case, in the OCV control, as the frequency is once reduced from the region fb and is brought closer to f1 (i.e., to the high frequency region), the output voltage gradually increases and reaches a target value at the operating point P3 in the region fa1. Afterward, as the discharge lamp is started by the starter circuit 4, a transition is made to a lighting control (control of the power applied to the discharge lamp), where the control is conducted in the region fb. The transition from the region fa2 to the region fb may be performed step-by-step or by gradually increasing the frequency.

If the discharge lamp is extinguished for some reason other than in response to an extinction instruction, the lighting shift control is again entered. Basically, the control returns to P2, and then shifts from P2 to P3 and to P4; but the control is shifted, for example, to P3 by reducing the frequency when the DC input voltage is reduced, as will be described below).

While the operating point P2 indicates a certain determined frequency (fixed value) within the frequency region fb, P4 does not always indicate a fixed frequency (a frequency which varies depending on a particular lighting state of the discharge lamp).

When the frequency is increased before the power supply is applied, a shift to the frequency region fb higher than f2 is made, indicated by the operating point P2, because the lighting shift control is made general. For example, when the OCV control alone is taken into consideration, a necessary output voltage can be provided even if the frequency is defined at a frequency value lower than f1 immediately after power-on. If the discharge lamp is extinguished after lighting by some reason, the OCV value can be increased as long as the operating point lies in the region fb by reducing the frequency to the resonance frequency f1 upon extinction from the higher frequency side. Therefore, the sequence of the lighting shift control can be made identical without the need for distinguishing the extinction immediately after the application of the power supply from the extinction after the discharge lamp is once lit. Also, the circuit configuration is simplified because the circuit portion responsible for the control is shared, as compared with a circuit which distinguishes the extinction immediately after the application of the power supply from the extinction after the discharge lamp has once been lit.

Furthermore, when the resonance frequencies f1, f2 have values higher than the AM (amplitude modulation) band and lower than the short wave and FM (frequency modulation) bands, the frequency traverses the resonance frequencies f1, f2 to the initial frequency at a stretch, advantageously affecting no detrimental effects such as radio noise and the like.

A preferable range for the frequency f is about 10 kHz or higher in view of a size reduction, and its upper limit value is restricted by the efficiency of the switching elements and the like (approximately 10 MHz for FET), and an upper limit value near 2 MHz is preferable in order to avoid the influence on the AM band and SW band.

As described above, a control action is implemented for transitioning the discharge lamp to stable lighting by moving a control range to the resonance curve g1 when the discharge lamp goes out and reducing the frequency f to increase the output voltage V. Taking advantage of this action, the discharge lamp can be kept lit in a situation in which the discharge lamp is about to extinguish as a result of reduced DC input voltage. Specifically, the lit discharge lamp is sustained by detecting that the DC input voltage has fallen to a predetermined threshold or lower, and shifting the switching element driving frequency to a frequency lower than the frequency range fb during the lighting to increase the output voltage V. In this way, it is possible to maintain the lighting state of the discharge lamp even if reduced power is supplied to the discharge lamp. Moreover, this can be accomplished without a large change in the circuit configuration or a significant increase in cost and the like.

Even when the DC input voltage is reduced, the frequency is controlled in accordance with the resonance curve g2 as long as the discharge lamp is not extinguished. Then, as the discharge lamp is extinguished, a transition is made to the resonance curve g1 to control lighting the discharge lamp again.

Even if the discharge lamp temporarily goes out, the discharge lamp is not controlled for lighting again when it is spontaneously ignited again (in this event, the state transitions between the two resonance curves g1, g2 without changing the frequency).

As shown in FIG. 2, as the frequency is increased from the operating point P2 closer to the resonance frequency f1, a larger output voltage can be generated than the maximum voltage at f2, in which case, however, the switching elements are more heavily burdened, so that a control state at a low frequency is not preferably continued for longer than necessary. As such, the following description will be given of a temporal restriction associated with the discharge lamp lighting shift control.

For limiting a stay time near the resonance frequency f1 during extinction, the frequency may be shifted to the frequency region fb after a predefined constant time period has elapsed from the time at which the discharge lamp is determined to be extinguished or at which the value of OCV has reached a target value. While a discharge start (breakdown) time of the discharge lamp may be defined as the origin of the time, the frequency can stay near f1 for a long time if the discharge lamp cannot be lit. Alternatively, when the origin of the time is defined at an extinction determination time or OCV target value reaching time, this implementation advantageously need not determine the lighting quickly.

The following implementations can be used when the discharge lamp discharge start point is not defined as the origin.

(1) The switching element driving frequency may be shifted temporarily to the frequency region fb after the lapse of a certain time from the start of the OCV control.

(2) The driving frequency may be shifted temporarily to the frequency range fb from the time OCV is boosted to a predefined voltage through a period in which the driving frequency for the switching elements is fixed.

Figure 3:
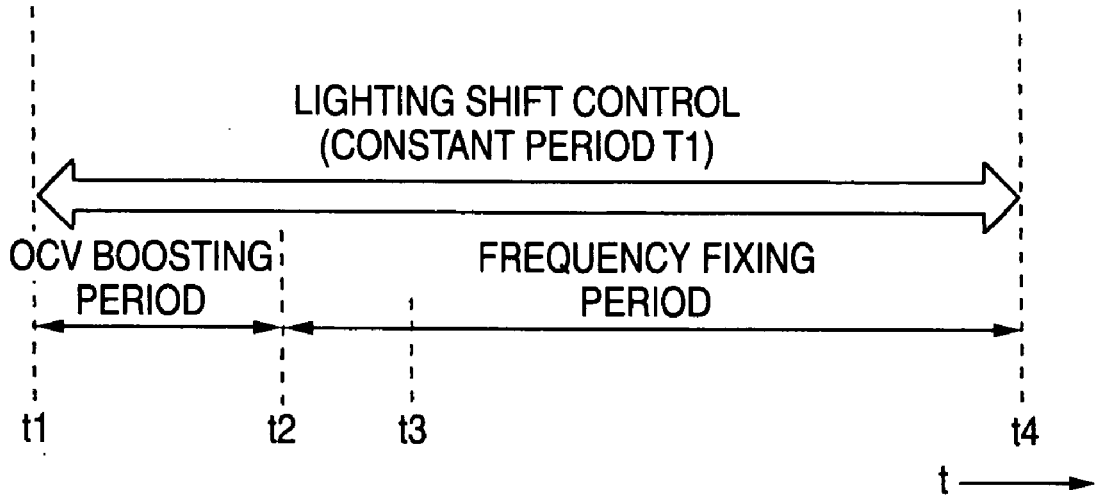
[FIG. 3] An explanatory diagram for a temporal restriction associated with a lighting shift control.

FIG. 3 is an explanatory diagram of arrangement (1), where the arrow "t" indicates the direction in which the time elapses.

A period "T1," which indicates a lighting shift control period (constant period), begins at time "t1" when it is determined that the discharge lamp is extinguished, and the lighting shift control is initiated based on the result of the determination. The period T1 includes an OCV boosting period which is taken to boost OCV to a target voltage, and a frequency fixing period for performing a switching control with the driving frequency fixed at a predetermined value after OCV has reached the target value. "T1" in FIG. 3 indicates a time at which OCV has reached the target value; "t2" indicates a time at which the discharge lamp is turned on; and "t4" indicates a time at which T1 has elapsed.

The switching element driving frequency is defined at a frequency higher than f2 after the OCV boosting period and the frequency fixing period subsequent to the OCV boosting period. The length of period T1, which includes both the periods, is constant, and after the period T1 has elapsed, the frequency is shifted into the region fb, without fail, irrespective of whether the discharge lamp is lit or extinguished, thereby restricting a stay time near f1. In determining the length of the period T1, the discharge lamp is lit with higher certainty as the period is longer, but taking into consideration the fact that a period longer than necessary would increase the probability of loss and failure, the length of the period T1 preferably satisfies both requirements.

Figure 4:
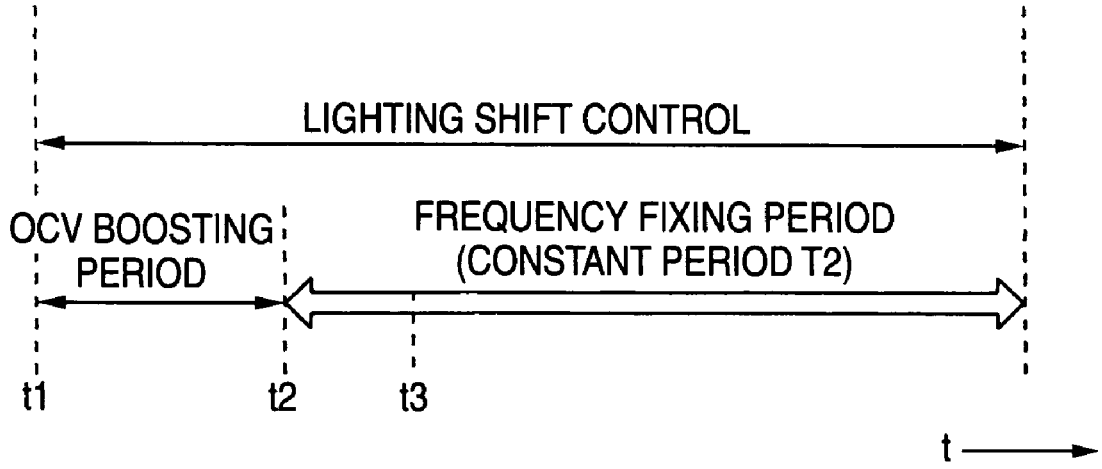
[FIG. 4] An explanatory diagram showing another example for the temporal restriction associated with the lighting shift control.

FIG. 4 is an explanatory diagram of the arrangement (2), which differs from the aforementioned arrangement (1) in that the frequency fixing period, indicated by "T2," is restricted to be a constant period.

In this embodiment, OCV is increased while the discharge lamp is extinguished, and the switching element driving frequency is fixed at a constant value over the fixed period T2 after the OCV has reached the target value. Within this frequency fixing period T2, a starting signal is generated for the discharge lamp and is applied to the discharge lamp.

FIGS. 5 to 13 illustrate specific circuit configurations according to the invention.

First, a description will be given of an exemplary configuration of the arrangement (1).

Figure 5:
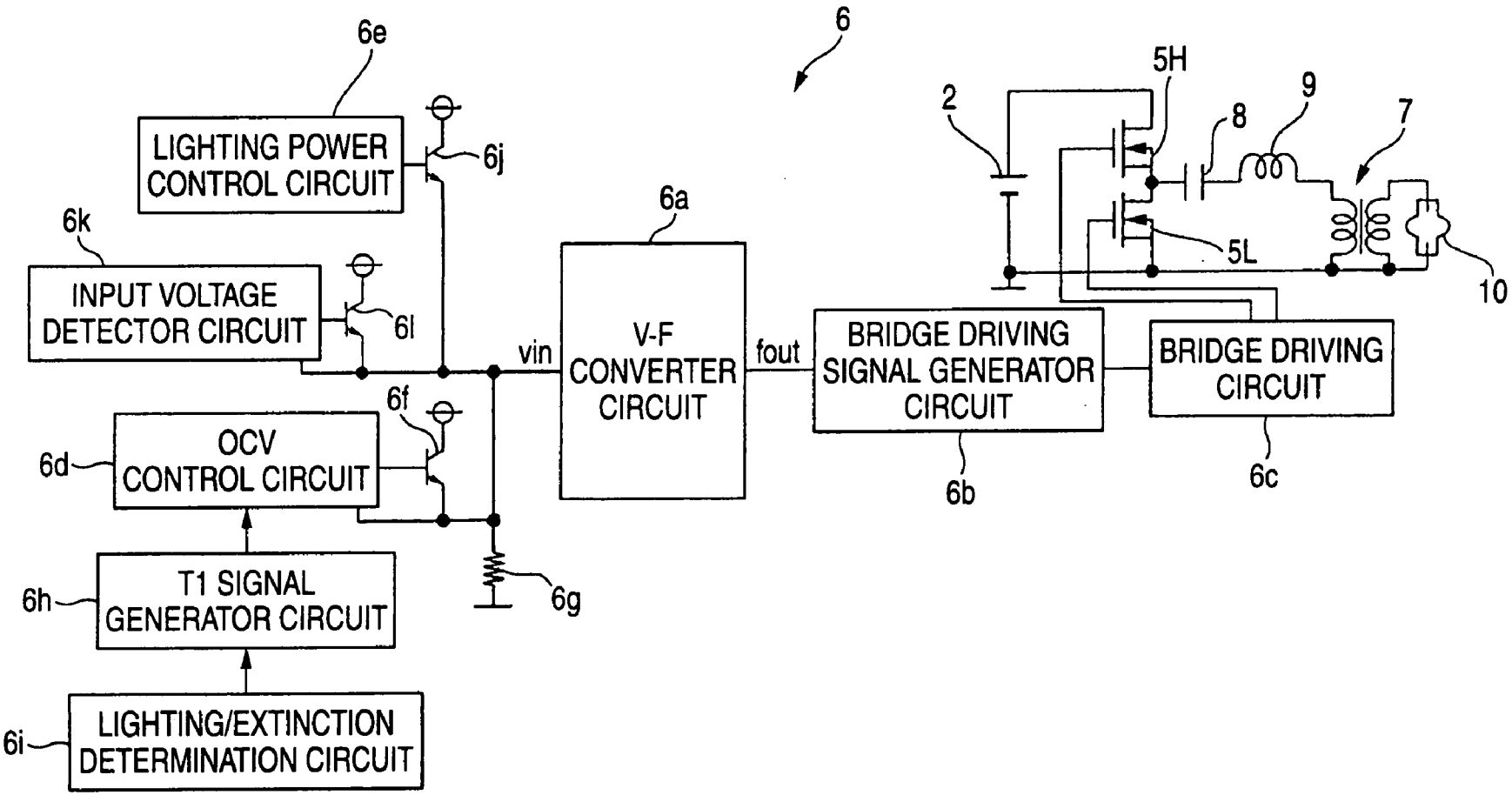
[FIG. 5] A block diagram illustrating an example of a circuit configurations according to the invention together with FIGS. 6 to 13, where

FIG. 5 illustrates an example of a circuit configuration of the control means 6 and employs a voltage-frequency converter circuit (hereinafter called the "V-F converter circuit") which changes the frequency depending on an input voltage. "Vin" in FIG. 5 indicates the input voltage to the V-F converter circuit 6*a*, and "fout" indicates the frequency of the output voltage converted by the V-F converter circuit 6.

The V-F converter circuit 6*a* has a control characteristic such that higher Vin causes lower fout. Its output voltage is sent to a subsequent bridge driving signal generator circuit 6*b* which delivers its output signal to respective control terminals of switching elements 5H, 5L through a bridge driving circuit 6*c*. For example, in a frequency region higher than the resonance frequency, a larger value of Vin results in a lower value of fout, and as a result, the output power (or voltage) is controlled in a direction in which the output power is increased. Conversely, a smaller value of Vin results in a higher value of fout, thereby suppressing the output power (or voltage) in a direction in which the output power is reduced.

In this way, Vin is a control voltage associated with the switching element frequency control, and is defined by respective outputs of the OCV control circuit 6*d*, lighting power control circuit 6*e*, and input voltage detector circuit 6*k*.

The OCV control circuit 6*d* controls a non-load output voltage before the discharge lamp is turned on. An emitter output of an NPN transistor 6*f* disposed at an output stage of this circuit is generated across a resistor 6*g*, and is supplied to an input terminal of Vin.

A T1 signal generator circuit 6*h* generates a pulse signal having a width corresponding to the lighting shift control period "T1" in response to a signal from a lighting/extinction determination circuit 6*i*. The pulse signal is sent to the OCV control circuit 6*d*.

The lighting power control circuit 6*e* controls applied transient power after the discharge lamp has been turned on, and applied power in a steady state. An emitter output of an NPN transistor 6*j* disposed at the output stage of the circuit 6*e* is sent to the V-F converter circuit 6*a*. The lighting power control circuit 6*e* may be of any configuration, so that any known configuration may be employed. For example, circuit 6*e* may include an error amplifier which performs operational processing based on a voltage detection signal and a current detection signal of the discharge lamp, a limiter (for a lower limit) for limiting a control output to prevent the driving frequency from becoming lower when the discharge lamp is turned on, or the like.

An input voltage detector circuit 6*k* detects a DC input voltage from the DC power supply, and delivers an output voltage for reducing the lighting frequency, when the DC input voltage decreases to a predefined threshold or lower, to the V-F converter circuit 6*a* as the emitter output of the NPN transistor 61.

The highest voltage is selected from the respective outputs of the OCV control circuit 6*d*, lighting power control circuit 6*e*, and input voltage detector circuit 6*k*, and is supplied to the V-F converter circuit 6*a* as a control voltage. An output voltage at a frequency generated by converting the voltage is supplied as a control signal to the switching elements 5H, 5L, respectively, through the bridge driving signal generator circuit 6*b* and bridge driving circuit 6*c*.

As illustrated in FIG. 1, in the circuit configuration in which the DC-AC converter circuit 3 converts a DC input to an AC output and boosts the AC output for controlling the power to the discharge lamp, a winding may be added to the inductance element 9 for resonance to detect a current flowing through the discharge lamp 10 or a voltage across the discharge lamp 10. Alternatively, a winding may be added to the transformer to pick up a current detection value and a voltage detection value of the discharge lamp.

For example, as illustrated in FIG. 1, the auxiliary winding 11, which forms the transformer together with the inductance element 9, is provided to detect a current corresponding to a current which flows through the discharge lamp 10, and the output of the auxiliary winding is sent to the current detector circuit 12. In other words, the detection of the current through the discharge lamp is performed using the inductance element 9 and auxiliary winding 11, and the result of the detection is sent to the control means 6 for use in controlling the power to the discharge lamp 10 and determining whether the discharge lamp is lit or extinguished.

Detection of the voltage across the discharge lamp 10 is based on the output of the primary winding 7*p* of the transformer 7 or the secondary winding 7*s* of the transformer 7, or the output of a winding 7*v* attached to the winding for detection. In this example, the output of the winding 7*v* for detection is sent to the voltage detector circuit 13 which acquires a detected voltage corresponding to the voltage across the discharge lamp 10. Then, the detected voltage is sent to the control means 6 for use in controlling the power to the discharge lamp 10 and determining whether the discharge lamp is lit or extinguished.

Figure 6:
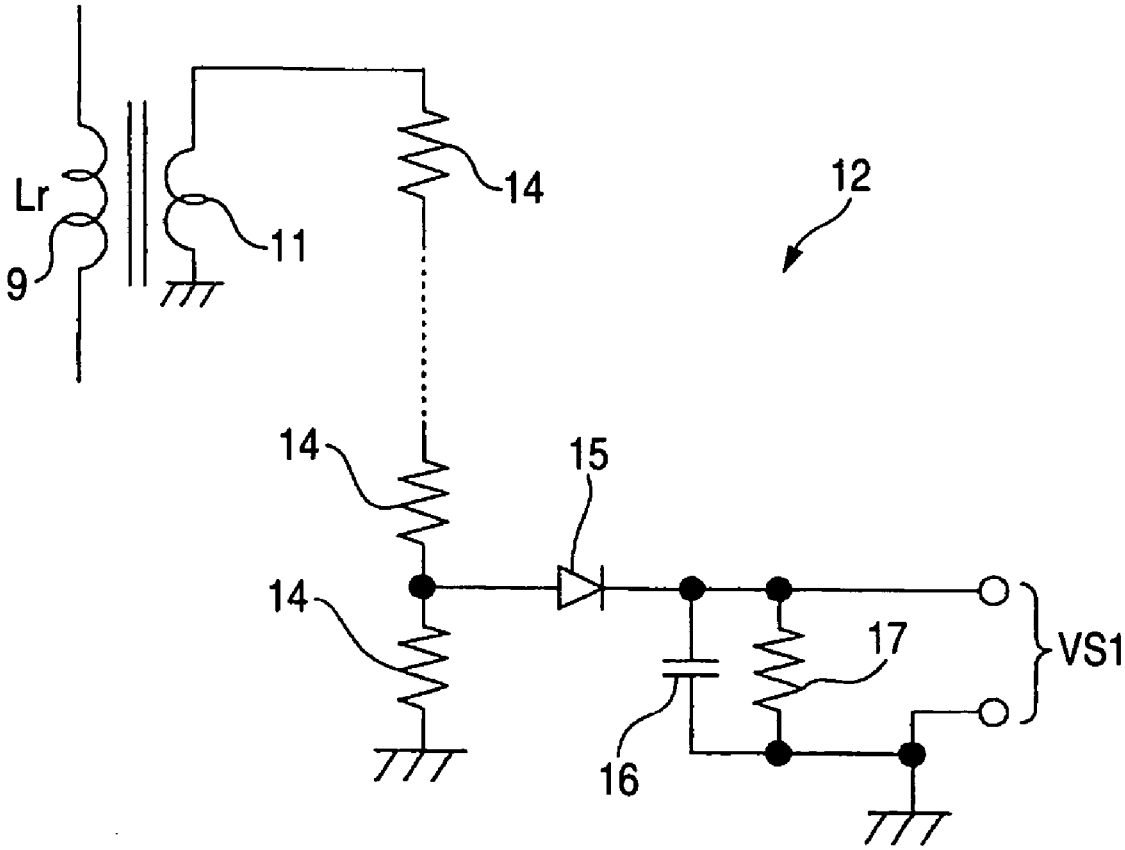
[FIG. 6] A circuit diagram illustrating an example of a discharge lamp current detector circuit.

FIG. 6 illustrates an example of a configuration of the current detector circuit 12.

A plurality of voltage dividing resistors 14 are connected in series to one end (non-grounded terminal) of an auxiliary winding 11. The voltage dividing resistor 14 positioned at the lowest stage has one end connected to a diode 15, and the other end grounded. The anode of the diode 15 is applied with a voltage divided by the resistors 14, and the cathode of the diode 15 is connected to one of detection output terminals.

A capacitor 16 has one end connected to the cathode of the diode 15, and the other end grounded. A resistor 17 is connected in parallel with the capacitor 16.

In this way, a detector circuit in a basic configuration can be used as the current detector circuit 12, and an AC signal detected by the inductance element 9 and auxiliary winding 11 is converted to a DC signal (see the detected voltage "VS1" in FIG. 6).

The starting signal (pulse voltage) generated by the starter circuit 4 may be divided by a plurality of resistive elements to reduce a detected voltage corresponding to a peak voltage to a level at which the resulting voltage will not cause any problem. Therefore, an simple circuit configuration can be employed for limiting a high voltage that may be generated when the discharge lamp is started.

The current detection signal delivered from the current detector circuit 12 may be used in the OCV control circuit 6*d*, described below.

Figure 7:
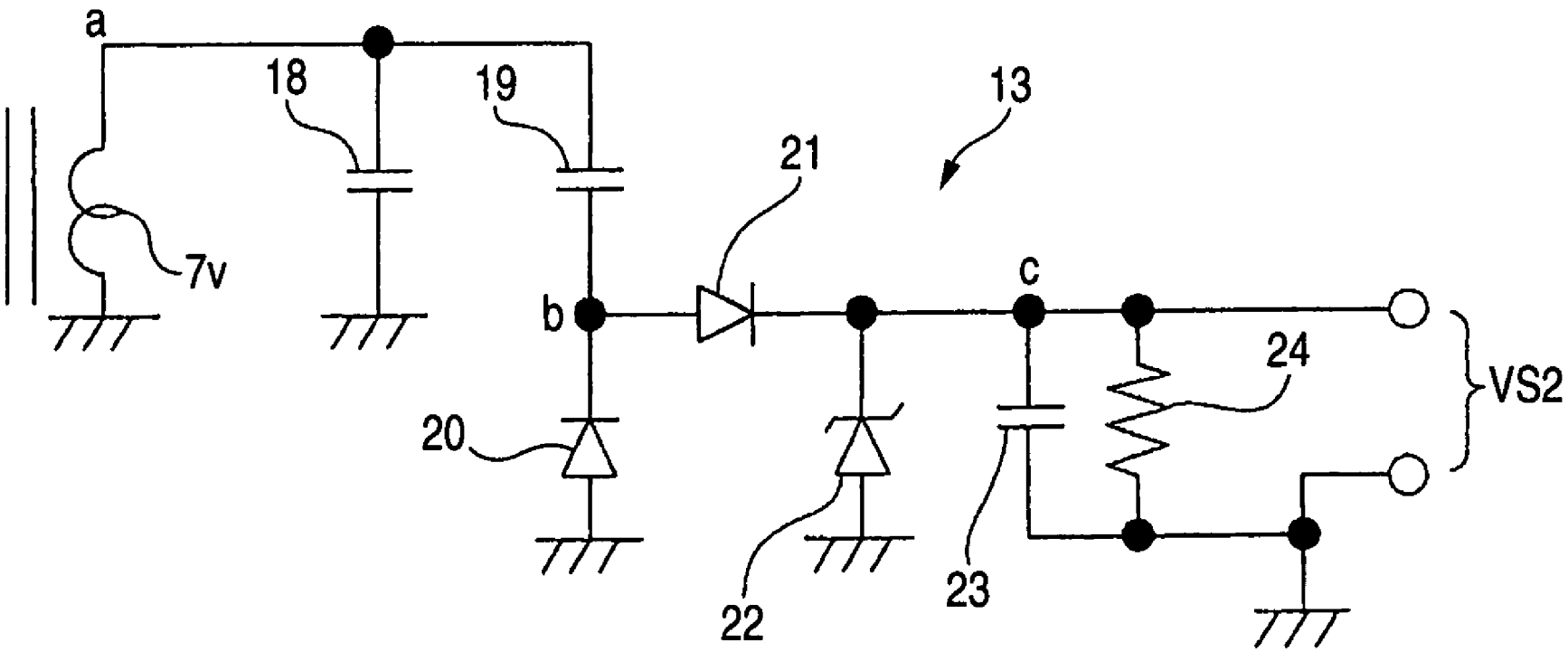
[FIG. 7] A circuit diagram illustrating an example of a discharge lamp voltage detector circuit.

FIG. 7 illustrates an example of a configuration of the voltage detector circuit 13.

The non-grounded terminal of the winding 7*v* for detection (see point a in FIG. 7) is connected to one end of a capacitor 18 which has the other end grounded. A capacitor 19 arranged in parallel with the capacitor 18 is connected to the cathode of a diode 20 and to an anode of a diode 21. The anode of the diode 20 is grounded.

The cathode of the diode 21 is connected to one of the detection output terminals, and is also connected to the cathode of a zener diode 22 and to one end of a capacitor 23. The anode of the zener diode 22 and the other end of the capacitor 23 are both grounded.

A resistor 24 is connected in parallel with the capacitor 23, and a detected voltage ("VS2") is delivered from the detected output terminals.

In the foregoing configuration, the winding 7*v* for detection is applied with a voltage with a high voltage pulse added to the circuit when the discharge lamp is started, where the voltage can be detected using the capacitors 19, 23 and resistor 24. The impedances of the capacitors 19, 23 are determined such that the impedance of the capacitor 23 is smaller by one magnitude than the impedance of the capacitor 19, and the resistance of the resistor 24 is relatively large compared to the impedance of the capacitor 23. The voltage applied at a point b (a connection of the anode of the diode 21 with the capacitor 19) in FIG. 7 is determined by the impedance ratio of the capacitors 19, 23.

After the discharge lamp is lit, the current flows only in one direction by the action of the diode 21, causing the capacitor 23 to be charged so that the voltage across the capacitor 23 (see point c in FIG. 7) increases. When the potential at one end of the winding 7*v* for detection (potential at the point a in FIG. 7) becomes substantially equal to the terminal potential across the capacitor 23 (potential at the point c in FIG. 7), no current flows into the capacitor 19. In other words, the voltage during the steady state of the discharge lamp can be detected without being divided by the capacitors 19 and 23, even if a small voltage is applied to the winding 7*v* for winding, thereby ensuring the required accuracy.

The capacitor 18 at the first stage is provided to absorb a re-ignition voltage. The zener diode 22, in turn, serves as a clamping element to suppress a high voltage associated with the generation of the starting pulse voltage, and limits a surge voltage upon generation of the pulse voltage.

Figure 8:
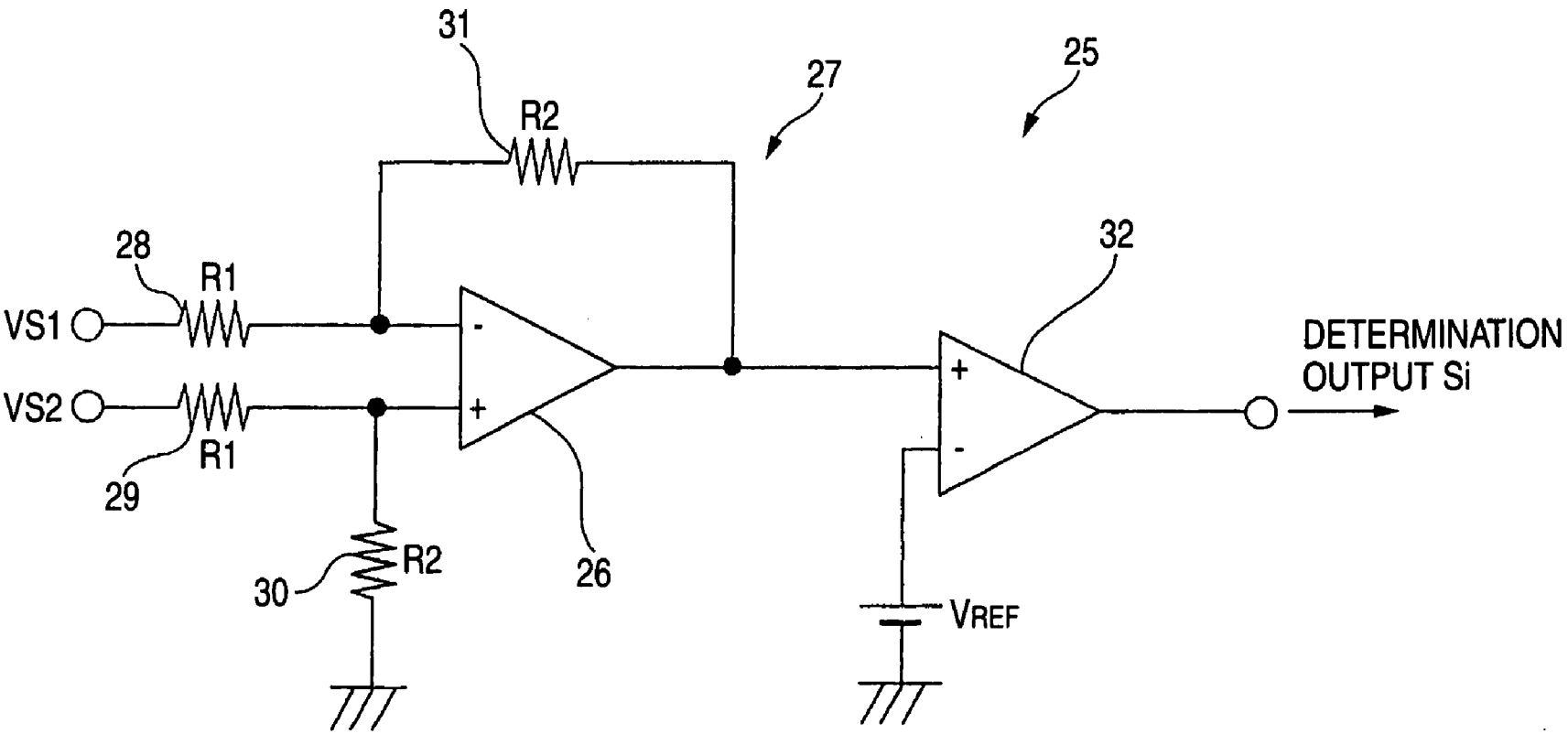
[FIG. 8] A diagram illustrating an example of a circuit configuration of a lighting/extinction determining means.

FIG. 8 is a circuit diagram illustrating an example of a configuration 25 of the lighting/extinction determination circuit 6*i*.

The voltage "VS1" detected by the current detector circuit 12, and the voltage "VS2" detected by the voltage detector circuit 13 are supplied to a subtractor circuit 27 which uses an operational amplifier 26. Specifically, "VS1"0 is supplied to an inverting input terminal of the operational amplifier 26 through a resistor 28, whereas "VS2" is supplied to a non-inverting input terminal of the operational amplifier 26 through resistors 29 and 30. The resistor 30 has one end connected to the non-inverting input terminal of the operational amplifier 26, and the other end grounded, and a resistor 31 is interposed between the inverting input terminal and output terminal of the operational amplifier 26. The resistors 28 and 29 are equal in resistance (labeled "R1"), and the resistors 30, 31 are equal in resistance (labeled "R2").

The operational amplifier 26 sends an output (R2/R1)·(VS2−VS1), which is proportional to the difference between VS2 and VS1, to a positive input terminal of a comparator 32. A predetermined reference voltage (labeled "VREF") is supplied to the negative input terminal of the comparator 32, which compares the operating result proportional to "VS2−VS1" with Vref to determine whether the discharge lamp is lit or extinguished. Specifically, when the output level of the operational amplifier 26 is equal to or higher than VREF, the comparator 32 generates an output signal at H (high) level, meaning that the discharge lamp is extinguished. On the other hand, when the output level of the operational amplifier 26 is lower than VREF, the comparator 32 generates an output signal at L (low) level, indicating that the discharge lamp is lit.

This example is provided with a circuit for subtracting a detected current value from a detected voltage value associated with the discharge lamp, and comparing the difference with the threshold voltage, resulting in a discharge lamp lighting/extinction determination signal (labeled "Si") in the form of a binary signal.

Figure 9:
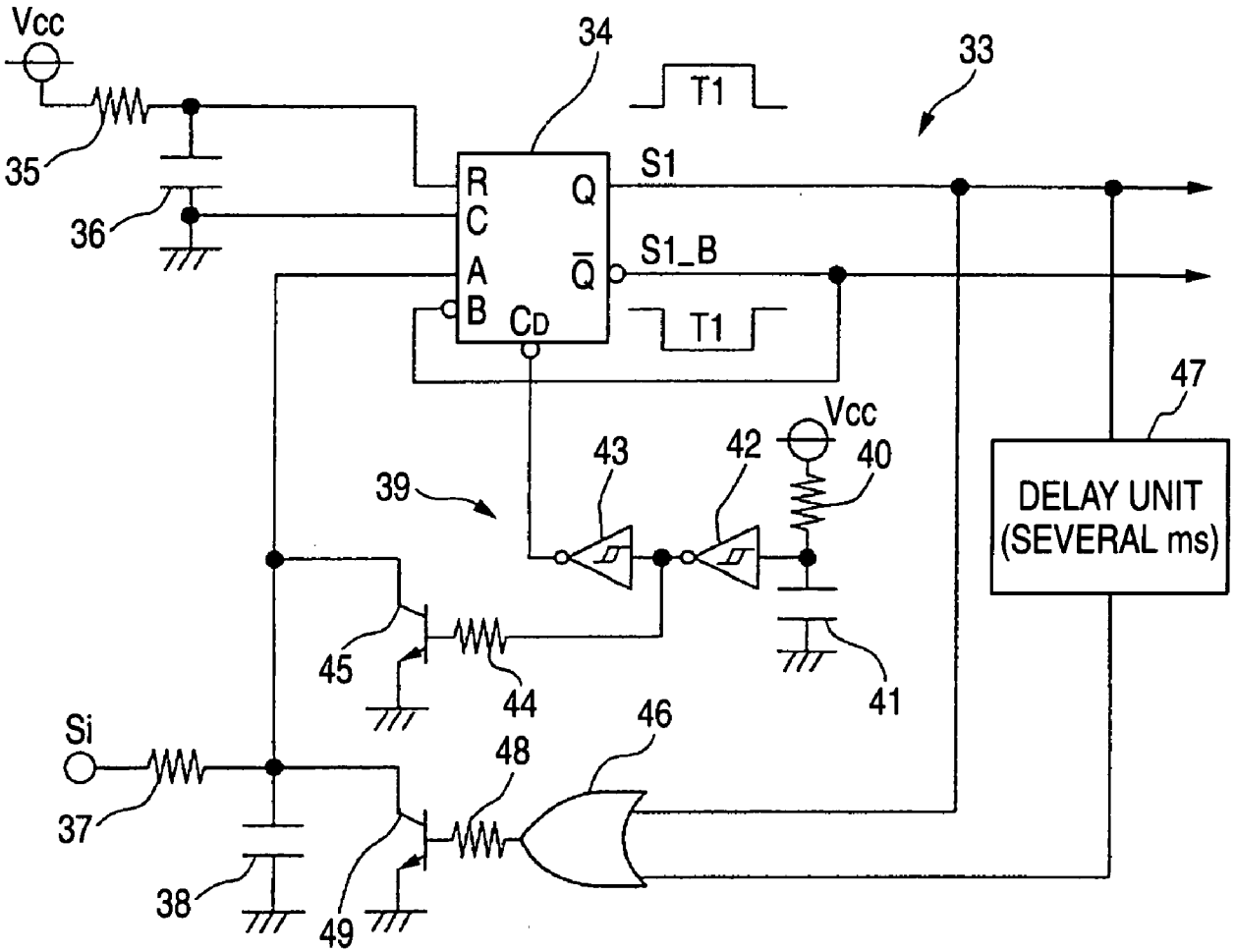
[FIG. 9] A diagram illustrating an example of a configuration of a T1 signal generator circuit.

FIG. 9 is a circuit diagram illustrating an example 33 of the T1 signal generator circuit 6*h*.

In this example, a monostable multi-vibrator IC is employed to generate a pulse signal "S1" having a constant duration T1, and an inverted version of the pulse signal "S1_B" which are sent to an OCV control circuit 6*d*, described below. Specifically, as the lighting/extinction determination signal Si goes to H-level when the discharge lamp is turned off, an H-level signal is applied to the monostable multi-vibrator 34 through an RC filter (composed of a resistor 37 and a capacitor 38), and the monostable multi-vibrator 34 generates the signals S1, S1_B having a width corresponding to the lighting shift period T1.

The monostable multi-vibrator 34 is supplied at an R-terminal with a predetermined power supply voltage "Vcc" through a resistor 35. A capacitor 36 has one end connected to a resistor 35 and R-terminal, and the other end connected to a C-terminal and also grounded. The length of the duration T1 is defined by setting a time constant using the resistor 35 and capacitor 36.

An A-terminal (input terminal) of the monostable multi-vibrator 34 is connected to a connection of a resistor 37 with a capacitor 38. One end of the resistor 37 is supplied with the lighting/extinction determination signal Si, whereas the other end of the resistor 37 is grounded through the capacitor 38. The signal Si indicates the H-level when it is determined that the discharge lamp is in a non-lighting state, and indicates the L-level when it is determined that the discharge lamp is in a lighting state.

A CD-terminal (L-active input) of the monostable multi-vibrator 34 is supplied with a POR signal from a POR (power on reset) circuit 39 upon initialization. In this example, the POR circuit 39 is composed of an CR circuit including a resistor 40 and a capacitor 41, and two Schmitt trigger-type NOT (logical not) gates 42, 43. The supply voltage Vcc is supplied to one end of the resistor 40, the other end of which is grounded through the capacitor 41. An input terminal of the preceding NOT gate 42 is connected between the resistor 40 and capacitor 41, and an output signal of the NOT gate 42 is sent to the CD-terminal through the subsequent NOT gate 43. The output signal of the NOT gate 42 is supplied to a base of a emitter-grounded NPN transistor 45 through a resistor 44, and the transistor 45 has a collector connected to one end of the capacitor 38 (the transistor 45 temporarily turns on upon initialization).

The pulse signal S1 is outputted from a Q-terminal of the monostable multi-vibrator 34, and has a pulse width equal to the length of the duration T1 from the time the lighting/extinction determination signal Si goes to H-level. The pulse signal S1_B, in turn, is provided from a Q(Bar) terminal ("–" is added above "Q" in FIG. 9), and supplied to the B-terminal (L-active input).

The pulse signal S1 is supplied to one input terminal of a two-input OR (logical or) gate 46, and also is supplied to the other input terminal of the OR gate 46 through a delay unit (delay element or the like) 47. Then, an output signal of the OR gate 46 is sent to a base of an NPN transistor 49 through a resistor 48. The transistor 49, which is emitter grounded, has a collector connected to one end of the capacitor 38. These circuit sections are provided to prevent possible detrimental effects resulting from an error in determining whether the discharge lamp is lit or extinguished. Specifically, when the frequency is shifted into the frequency region fb after the discharge lamp is turned on in the frequency region fa2 (see FIG. 2), a detected voltage and current of the discharge lamp can instantaneously become instable, causing an erroneous determination on the lighting/extinction. For example, if the discharge lamp is determined to be extinguished even though it is lit, the frequency can be shifted to the frequency region fa2 (except for the region fb). Thus, to avoid such an inconvenience, the transistor 49 is turned on for several milliseconds after a shift to the region fb to mask the lighting/extinction determination signal Si (forced to L-level).

In this example, the duration T1 is set using a CR time-constant circuit, but the invention is not limited to this circuit configuration, and an internal basic clock may be counted by a counter.

Figure 10:
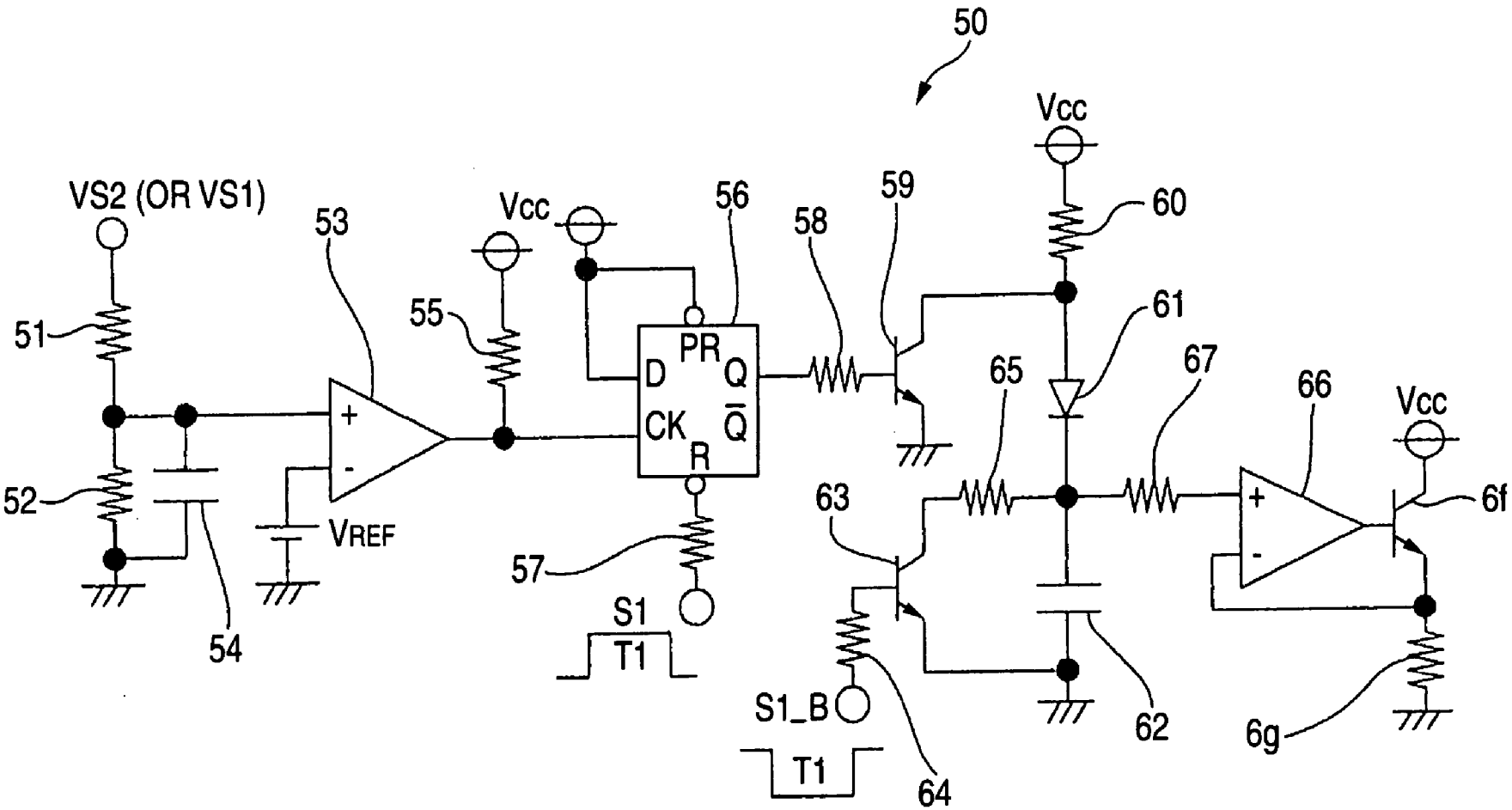
[FIG. 10] A diagram illustrating an example of a configuration of an OCV control circuit.

FIG. 10 is a circuit diagram illustrating an example 50 of the OCD control circuit 6*d*.

The detected voltage SV2 (or SV1) is divided by resistors 51, 52, and the resulting voltage is supplied to a positive input terminal of a comparator 53. A predetermined reference voltage (labeled "VREF") is supplied to a negative input terminal of the comparator for comparing the detected value VS2 (or VS1) with VREF. A capacitor 54 is connected in parallel with the resistor 52, whereas a pull-up resistor 55 is connected to an output terminal of the comparator 53.

A predetermined supply voltage Vcc is supplied to a D-terminal and an L-active PR (preset) terminal of a D-flip flop 56, whereas an output signal of the comparator 53 is supplied to a clock signal input terminal (CK). The signal S1 is supplied to an L-active R (reset) terminal through a resistor 57.

An output signal of the D-flip flop 56 is sent to a base of an emitter-grounded NPN transistor 59 through a resistor 58. The transistor 59 has a collector connected to a circuit power supply terminal (supply voltage Vcc) through a resistor 60.

A diode 61 has an anode connected to one end of the resistor 60, and a cathode connected to one end of the capacitor 62. The other end of the capacitor 62 is grounded.

The signal S1_B is supplied to a base of an emitter-grounded NPN transistor 63 through a resistor 64. The transistor 63 has a collector connected between the diode 61 and capacitor 62 through a resistor 65.

An operational amplifier 66, which forms part of a buffer together with an NPN transistor 6*f* arranged at its output stage, has a non-inverting input terminal connected between the diode 61 and capacitor 62 through a resistor 67. An output terminal of the operational amplifier 66 is connected to a base of the transistor 6*f* which has an emitter connected to an inverting input terminal of the operational amplifier 66 and also grounded through a resistor 6*g*. The supply voltage Vcc is supplied to a collector of the transistor 6*f*.

In this circuit, upon powering up or turning on the discharge lamp, the signal S1 is at L-level, causing the D-flip flop 56 to be reset. Consequently, the Q-output signal is at L-level, and the transistor 59 is off. Also, since the signal S1_B is at H-level, the transistor 63 turns on, causing the terminal voltage across the capacitor 62 to be at L-level. Therefore, the output of the circuit is at L-level.

Upon extinguishing the discharge lamp, the signal S1 goes to H-level, releasing the D-flip flop 56 from the reset. Also, the signal S1_B goes to L-level, causing the transistor 63 to turn off, so that the capacitor 62 stops discharging, and charging of the capacitor 62 is started through the resistor 60 and diode 61. Together with this, the emitter potential of the transistor 6*f* increases, resulting in a lower frequency. In other words, in the frequency region fa2 (see FIG. 2), the frequency gradually becomes lower to increase the value of OCV. Then, as OCV reaches a target value (see P3 in FIG. 2), the output of the comparator 53 goes to H-level. Specifically, when a detected voltage divided by the resistors 51, 52 increases to VREF or higher, the D-flip flop 56 is set by the output signal of the comparator 53, causing the Q-output signal to change to H-level, so that the transistor 59 turns on to stop charging the capacitor 62. Thus, the terminal potential across the capacitor 62, and the emitter potential of the transistor 6*f* are fixed, and as a result, the frequency value is held constant. Then, at the time the lighting shift period T1 has elapsed, the signal S1 goes to L-level, the D-flip flop 56 is reset, causing the Q-output signal to change to L-level and the transistor 59 to turn on. On the other hand, the signal S1_B goes to H-level, causing the transistor 63 to turn on, so that the capacitor 62 discharges to change the terminal potential thereof to L-level. Consequently, the emitter potential of the transistor 6*f* goes to L-level, followed by termination of the frequency fixing period, and a transition of the frequency to the region fb.

Figure 11:
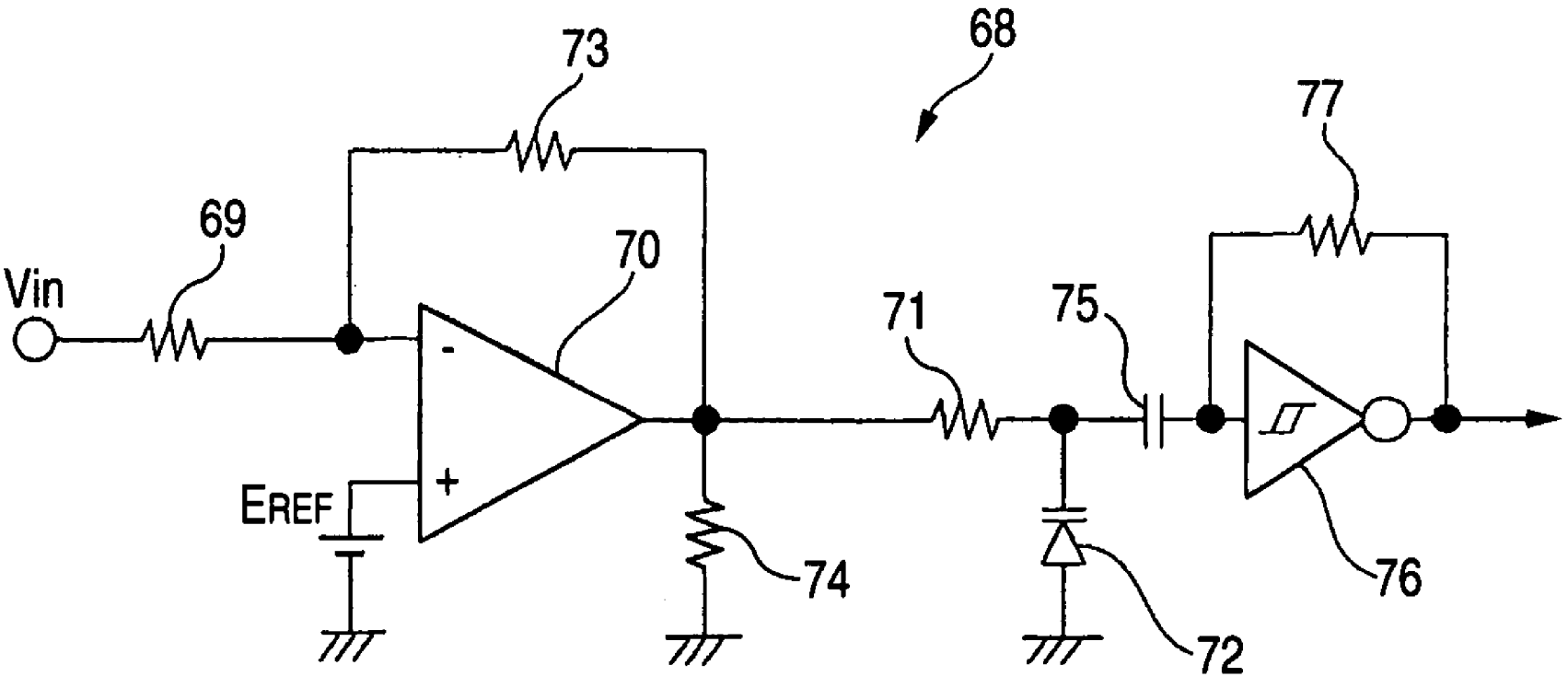
[FIG. 11] A diagram illustrating an example of a configuration of a V-F converter circuit.

FIG. 11 is illustrates a main portion of an example of a configuration 68 of the V-F converter circuit 6*a*.

The input voltage Vin is supplied to an inverting input terminal of an operational amplifier 70 through a resistor 69. A predetermined reference voltage "EREF" is supplied to a non-inverting input terminal of the operational amplifier 70, and an output signal of the operational amplifier 70 is applied to a voltage varied capacitance diode 72 through a resistor 71. A resistor 73 is interposed between the inverting input terminal and output terminal of the operational amplifier 70, and a resistor 74 has one end connected to the output terminal of the operational amplifier 70, and the other end grounded.

The voltage varied capacitance diode 72 has a cathode connected between the resistor 71 and capacitor 75, and an anode grounded. A Schmitt trigger type NOT gate 76 has an input terminal connected to the cathode of the voltage varied capacitance diode 72 through the capacitor 75, and a resistor 77 is connected in parallel with the NOT gate 76. A frequency variable oscillator circuit is formed of these elements, and an output pulse of the NOT gate 76 is sent to the subsequent bridge driving signal generator circuit 6*b*. The bridge driving signal generator circuit 6*b* generates a driving signal for controlling each switching element based on the pulse signal. Known configurations can be used.

In this example, as Vin increases (decreases) in level, the output voltage of the operational amplifier 70 decreases (increases) to increase (decrease) the static capacitance of the voltage varied capacitance diode 72. Consequently, the frequency of the output pulse decreases (increases).

Figure 12:
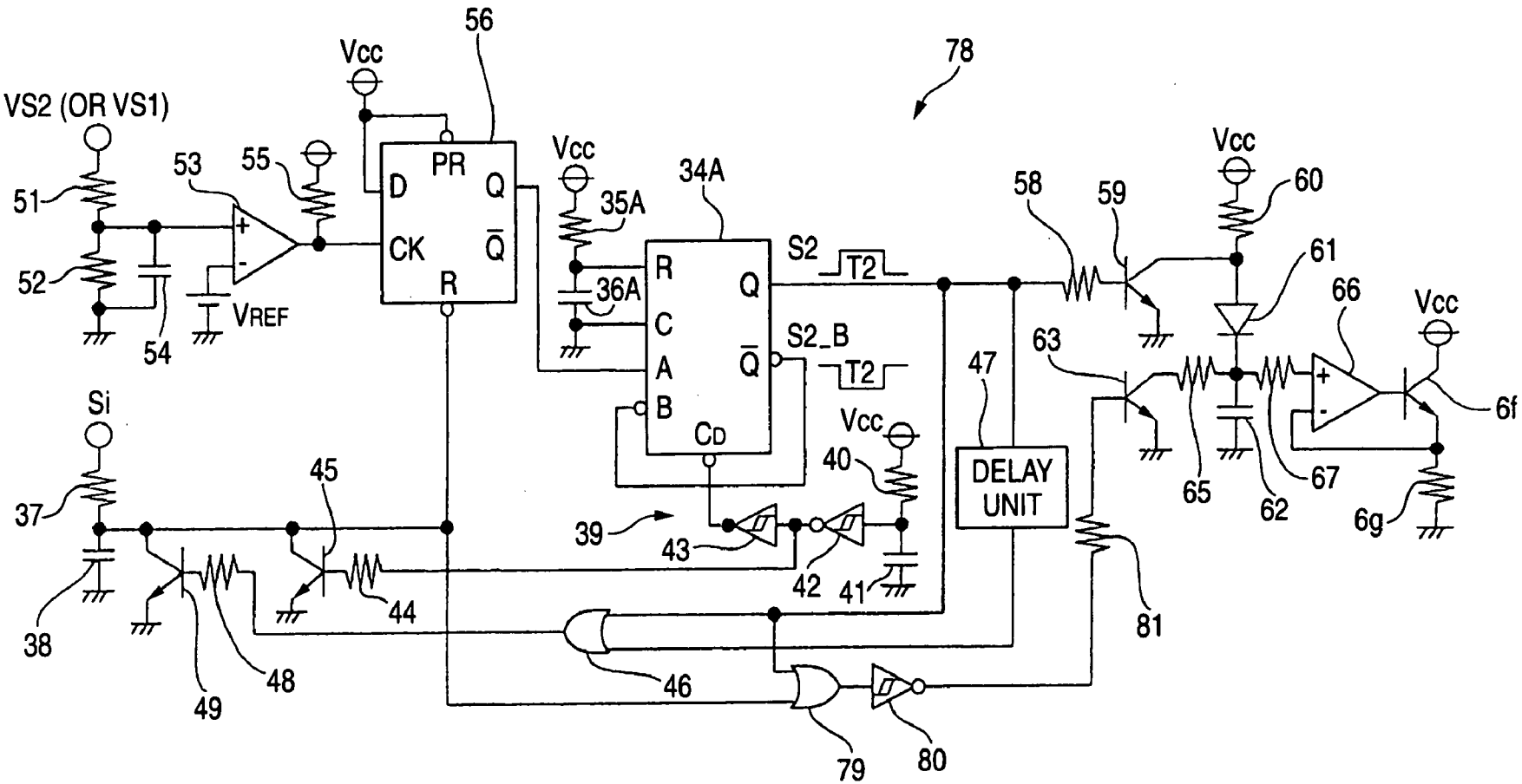
[FIG. 12] A circuit diagram illustrating an example of the OCV control circuit and T2 signal generator circuit.

Next, the arrangement (2) will be described with reference to FIG. 12. FIG. 12 illustrates an example of a configuration 78 of the OCV control circuit and T2 signal generator circuit associated with the frequency fixing period, with its output voltage sent to the V-F converter circuit 6*a*. In this example, parts similar to those in FIGS. 9 and 10 are designated with the same reference numerals.

The detected voltage VS2 (or VS1) is divided by resistors 51, 52, and the resulting voltage is supplied to a positive input terminal of a comparator 53. A reference voltage "VREF" is supplied to a negative input terminal of the comparator 53 for comparing the detected value VS2 (or VS1) with VREF. A capacitor 54 is connected in parallel with the resistor 52, and a pull-up resistor 55 is connected to an output terminal of the comparator 53.

A predetermined supply voltage Vcc is supplied to a D-terminal and a PR-terminal of a D-flip flop 56, and an output signal of the comparator 53 is supplied to a clock signal input terminal CK. Also, the lighting/extinction determination signal Si is supplied to an L-active R-terminal through a resistor 37 and a capacitor 38.

A Q-output signal of the D-flip flop 56 is inputted to an A-terminal of a subsequent monostable multi-vibrator 34A.

In this example, the monostable multi-vibrator 34A generates a pulse signal "S2" having a width of a constant duration T2, and an inverted version "S2_B" of the pulse signal S2.

A predetermined supply voltage "Vcc" is supplied to an R-terminal of the monostable multi-vibrator 34A through a resistor 35A. A capacitor 36A has one end connected to the resistor 35A and R-terminal, and the other end connected to a C-terminal and also grounded. The length of the duration T2 is defined by setting a time constant using the resistor 35A and capacitor 36A.

A POR signal is supplied to a CD-terminal (L-active input) of the monostable multi-vibrator 34A from a POR circuit 39 upon initialization. The POR circuit 39 is composed of a resistor 40, a capacitor 41, and a Schmitt trigger-type NOT gates 42, 43. The NOT gate 42 has an input terminal connected between the resistor 40 and capacitor 41, and an output signal of the NOT gate 42 is sent to the CD-terminal through the NOT gate 43. An output signal of the NOT gate 42 is supplied to a base of an emitter-grounded NPN transistor 45 through a resistor 44. The transistor 45 has a collector connected to one end of the capacitor 38.

The pulse signal S2 is outputted from a Q-output of the monostable multi-vibrator 34A, and has a pulse width equal to the length of the duration T2 from the time OCV reaches a target value. The pulse signal S2_B in turn is outputted from a Q(Bar) terminal ("–" is added above "Q" in FIG. 9), and supplied to the B-terminal (L-active input).

The pulse signal S2 is sent to a base of an emitter-grounded NPN transistor 59 through a resistor 58. The transistor 59 has a collector connected to a circuit power supply terminal (supply voltage Vcc) through a resistor 60. The pulse signal S2 also is supplied to one input terminal of an OR gate 46, and is supplied to the other input terminal of the OR gate 46 through a delay unit 47. Then, an output signal of the OR gate 46 is sent to a base of an emitter-ground NPN transistor 49 through a resistor 48. The transistor 49 has a collector connected to one end of the capacitor 38. These circuit sections are provided to prevent possible detrimental effects resulting from an error in determining whether the discharge lamp is lit or extinguished, as has been previously explained.

A diode 61 connected to the resistor 60 has its cathode connected to one end of a capacitor 62, the other end of which is grounded.

An emitter-grounded NPN transistor 63 has a collector connected between the diode 61 and capacitor 62 through a resistor 65. An output signal of a two-input OR gate 79 is supplied to a base of the transistor 63 through a Schmitt trigger-type NOT gate 80 and a resistor 81. In the OR gate 79, the signal S2 is supplied to one input terminal, whereas the lighting/extinction determination signal Si is supplied to the other input terminal through a CR circuit (composed of the resistor 37 and capacitor 38).

An operational amplifier 66, which forms part of a buffer together with an NPN transistor 6*f* arranged at its output stage, has a non-inverting input terminal connected between the diode 61 and capacitor 62 through a resistor 67. An output terminal of the operational amplifier 66 is connected to a base of the transistor 6*f* which has an emitter connected to an inverting input terminal of the operational amplifier 66 and also grounded through a resistor 6*g*. An emitter output of the transistor 6*f* is sent to the subsequent V-F converter circuit 6*a* as Vin.

In this circuit, upon powering up or turning on the discharge lamp, the signal S1 is at L-level, causing the D-flip flop 56 to be reset. Consequently, the Q-output signal is at L-level, the Q-output signal of the monostable multi-vibrator 34A is at L-level, and the transistor 59 is off. Also, the L-level signal outputted by the OR gate 79 is inverted to an H-level signal by the Schmitt trigger type NOT gate 80, causing the transistor 63 to turn on, and the terminal potential across the capacitor 62 to go to L-level. Therefore, the output of the circuit (see the emitter potential of the transistor 6*f*) is at L-level.

Upon extinguishing the discharge lamp, the signal S1 goes to H-level, releasing the D-flip flop 56 from the reset. Then, simultaneously, the output signal of the OR gate 79 goes to H-level which is inverted to the L-level by the NOT gate 80, causing the transistor 63 to turn off. Charging of the capacitor 62 begins, thus increasing the voltage across it. As the OCV value reaches a target value, the H-level signal outputted by the comparator 53 is inputted to the D-flip flop 56, the Q-output signal of which goes to H-level (latch) and is sent to the monostable multi-vibrator 34A. As a result, the signal S2 having a pulse width equal to the constant time T2 is outputted from the Q-terminal, causing the transistor 59 to turn on, so that the capacitor 62 is prevented from being charged. The transistor 63 remains off, so that the terminal potential across the capacitor 62 and the emitter potential of the transistor 6*f* are fixed, and as a result, the frequency value is kept constant. Meanwhile latching by the D-flip flop 56 is disabled.

As the constant time T2 elapses, the signal S2 goes to L-level, ad the D-flip flop 56 is reset after the lapse of a time set by the delay unit 47. The frequency shifts into the region fb after the frequency fixing period is over, but if the discharge lamp is turned off after it has been once turned on, the latch is enabled to again enter the lighting shift control.

Figure 13:
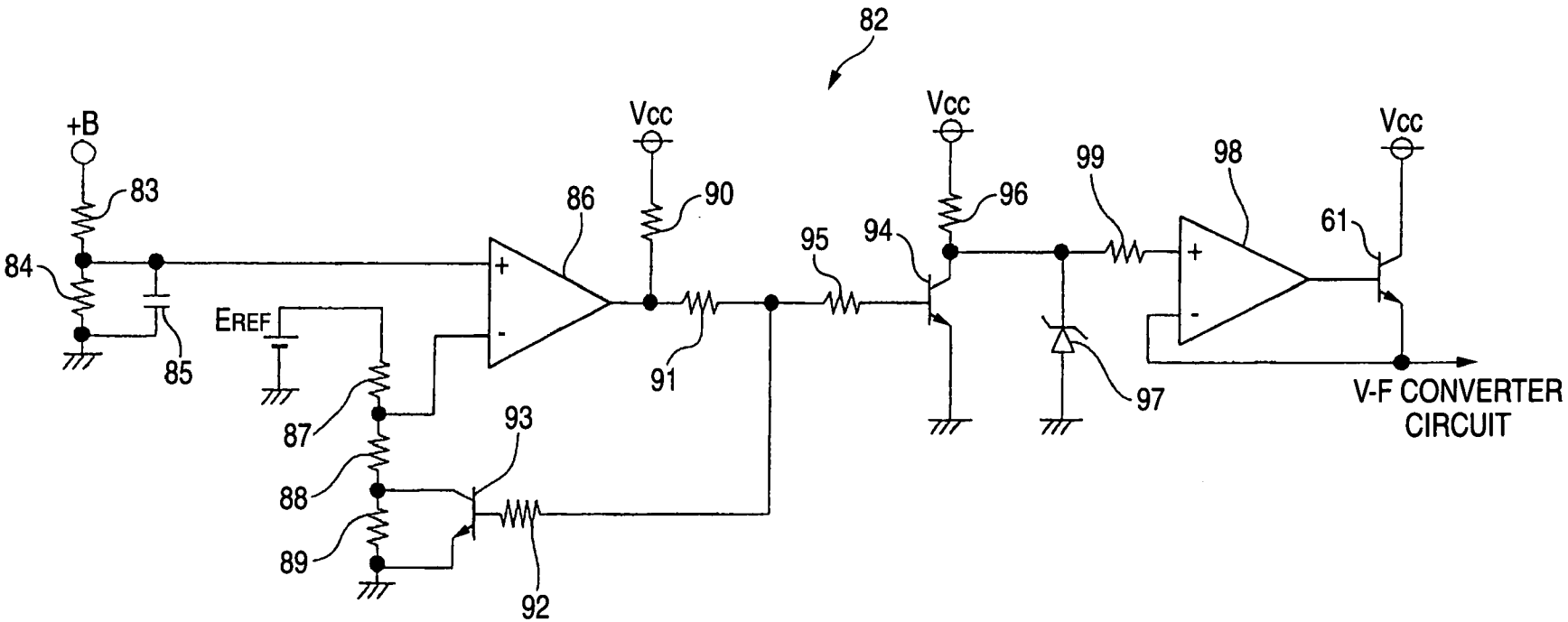
[FIG. 13] A circuit diagram illustrating an example of a configuration of an input voltage detector circuit.

FIG. 13 illustrates an example of a configuration 82 of the input signal detector circuit 6*k*.

A DC input voltage labeled "+B" is supplied to a positive input terminal of the comparator 86 after is divided using series resistors 83, 84. A capacitor 85 is connected in parallel with the resistor 84.

A series circuit of resistors 87, 88, 89 is supplied with a predetermined reference voltage "Eref" indicated by the symbol of a regulated voltage source, and a connection of the resistor 87 with the resistor 88 is connected to a negative input terminal of the comparator 86.

A pull-up resistor 90 is arranged at an output terminal of the comparator 86, and the output terminal is connected to a base of an emitter-grounded NPN transistor 93 through resistors 91, 92. The transistor 93 has a collector connected between the resistors 88 and 89.

An emitter-grounded NPN transistor 94 has its base connected to the output terminal of the comparator 86 through resistors 95, 91. The transistor 94 has a collector connected to a power supply terminal at a predetermined voltage (Vcc) through a resistor 96, and is also connected to a cathode of a zener diode 97 which has a grounded anode.

An operational amplifier 98, which forms part of a buffer together with an NPN transistor 61 arranged at its output stage, has a non-inverting input terminal connected to the collector of the transistor 94 and also to the cathode of the zener diode 97. The operational amplifier 98 has an output terminal connected to a base of a transistor 61 which has an emitter connected to an inverting input terminal of the operational amplifier 98, and an emitter output delivered to the subsequent V-F converter circuit 6*a*.

In the foregoing configuration, a detected voltage associated with the DC input voltage is compared with a predetermined reference voltage in the comparator 86 to define the transistor 94 to turn on or off in accordance with the result of the comparison. The comparator 86 is provided with a hysteresis characteristic, so that when the transistor 93 turns on in response to an H-level signal outputted from the comparator 86, a first reference voltage generated by the resistors 87, 88 is supplied to the negative input terminal of the comparator 86, bypassing the resistor 89. Also, when the transistor 93 turns off in response to an L-level signal outputted from the comparator 86, a second reference voltage generated by the resistors 87, 88, 89 is supplied to the negative input of the comparator 86.

When a DC input voltage is higher than the first reference voltage, the comparator 86 generates an output signal at H-level, causing the transistor 94 to turn on. Therefore, the output changes to L-level after it has passed through the operational amplifier 98 and transistor 61.

On the other hand, when a DC input voltage is lower than the second reference voltage, the comparator 86 generates an output signal at L-level, causing the transistor 94 to turn off. In this state, a voltage value determined by the zener diode 97 is outputted to the V-F converter circuit 6*a* through the operational amplifier 98 and transistor 61.

Figure 14:
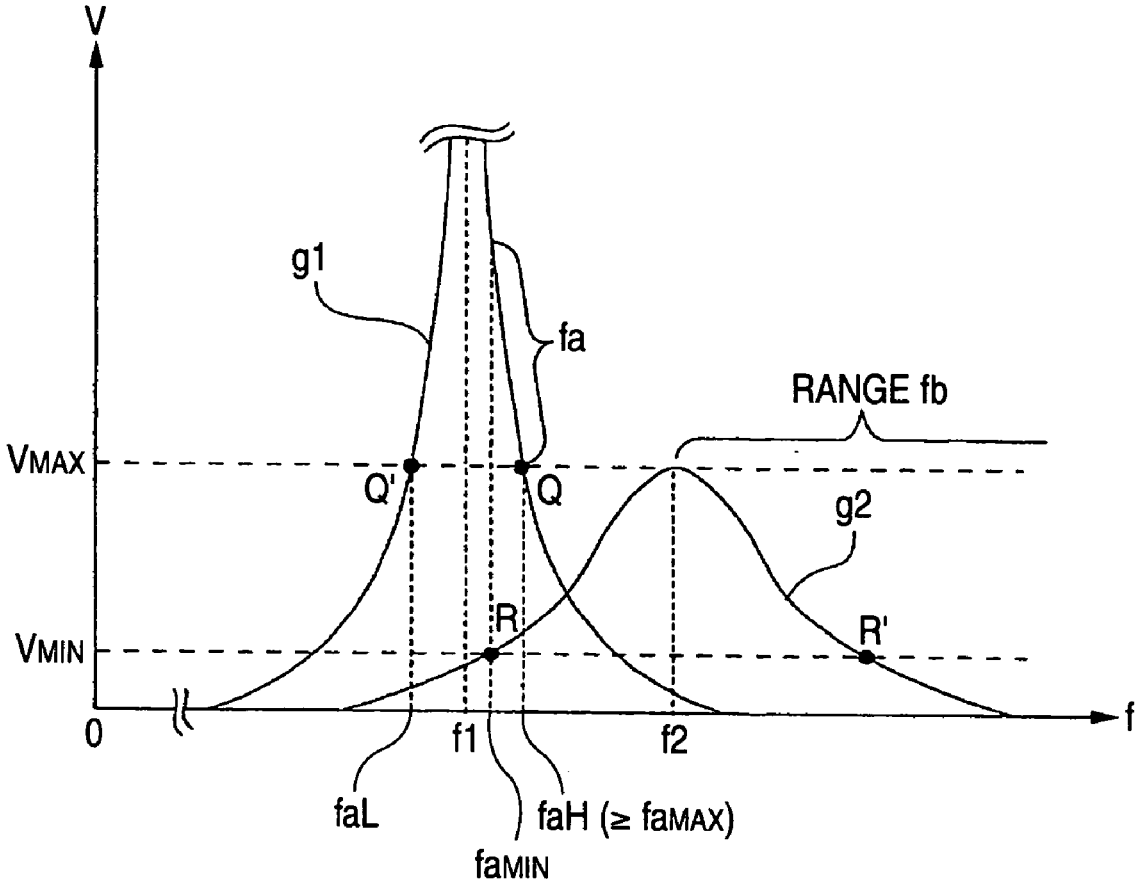
[FIG. 14] A diagram for explaining a frequency control range when a DC input voltage becomes lower.

FIG. 14 shows the resonance curves g1, g2, where the horizontal axis represents the frequency "f" and the vertical axis represents the output voltage "V."

Respective reference letters shown in FIG. 14 represent the followings:

"Vmax"=Maximum Output voltage during Lighting;

"Vmin"=Minimum Lamp Voltage which Can Maintain Lighting;

"faH"=Frequency at Upper Intersection Point Q of Resonance Curve g1 with "V=Vmax";

"faL"=Frequency at Lower Intersection Point Q' of Resonance Curve g1 with "V=Vmax";

"fa"=Control Range during Extinction or with Low Input Voltage (famin≦f≦famax);

"famin"=Frequency at Lower Intersection Point R of Resonance Curve g2 with "V=Vmin";

"famax"=Upper Limit Frequency of Control Range fa (famax≦faH); and

"fb"=Frequency Control Range during Lighting (f>f2)

As indicated by fa in FIG. 14 (in the illustrated example, "famax=faH" is satisfied), as the control range is set closer to the resonance frequency f1, the output voltage V increases. A value of fa excessively close to f1 would result in an excessively high output voltage which is problematic from the viewpoint of the breakdown and burden of circuit elements. Therefore, the circuit should be designed in consideration of an increase in size and cost of the circuit resulting from higher breakdown of parts.

The resonance curve g2 has a peak at Vmax. When the DC input voltage decreases, the frequency shifts to a range close to f1 such that a voltage which can be outputted in the control range fa is equal to or higher than a maximum value in the region fb.

When a switching element is being driven in the control range fa with the discharge lamp being in a lighting state, the static capacitance of the resonance capacitor and the aforementioned transformer or the inductance of the aforementioned inductance element must be set, paying attention to the lower limit (famin) and upper limit (famax) in order to ensure that the discharge lamp is kept lit.

As is understood from the relationship "Output Voltage in Control Range fa>Output Voltage in Frequency Range fb," in a situation where fa is defined above f1, its upper limit value is determined by the frequency faH at the intersection point Q. Then, a lower limit value of fa is determined by the intersection point R of the resonance curve g2 with a minimum voltage Vmin at which the discharge lamp can maintain the lighting state.

Although there are two intersection points of the resonance curve g2 with V=Vmin (the lower intersection point R and upper intersection point R'), the one which satisfies the condition that it is lower than famax (famin<famax), i.e., the intersection point R, gives the lower limit of fa.

Also, although in this example, the relationship "f1<famin<fa<famax≦faH<f2" is established, this is not a limitation, but "famin<f1" may be established. Specifically, in general, fa is included in the aforementioned range of equal to or higher than faL and equal to or lower than faH (however, "faL<faH" is satisfied), and when a DC input voltage decreases to a predefined threshold or lower, the switching element driving frequency (f) is shifted to a predetermined range within "faL≦f≦faH" so that the voltage V which can be outputted can be increased to Vmax or higher.

When the DC input voltage decreases, a condition for shifting the frequency to the control range fa is determined by setting a threshold associated with the detection of the voltage. Specifically, by achieving a shift from the frequency range fb to fa before the discharge lamp is extinguished as a result of a shortage of power supplied thereto, the discharge lamp can be ensured to be kept lit when the DC input voltage becomes lower. The threshold associated with the detection of the DC input voltage is preferably set to a value higher than a DC input voltage value with which the discharge lamp cannot be kept lit at f2. Specifically, with the discharge lamp kept lit, the DC input voltage gradually is reduced after the lighting frequency has been fixed at f2, and the DC input voltage is measured at the time the discharge light can no longer be kept lit. Then, the threshold may be set to a value slightly higher than the measured DC input value. In the example circuit of FIG. 13, a reference value for the comparator is set by setting the reference voltage (Eref) and the resistances of the respective resistors connected thereto.

Also, for shifting the frequency to a frequency lower than the region fb when the DC input voltage falls down to the predefined threshold or lower, the frequency is preferably set within the same frequency range fa as before the discharge lamp is turned on.

In the circuits illustrated in FIGS. 5 to 13, the output having the highest voltage is selected from the respective outputs of the OCV control circuit 6*d*, lighting power control circuit 6*e*, and input voltage detector circuit 6*k* for the input voltage Vin to the V-F converter circuit 6*a*, and the switching element driving frequency is defined by this voltage. In other words, since the driving frequency is lower as Vin is higher, there is established a relationship that a control voltage at f2 is lower than a control voltage at fa.

When the DC input voltage is equal to or lower than the aforementioned threshold, a control voltage defined by the zener voltage of the zener diode 97 (see FIG. 13) is predominant in Vin, and the driving frequency is forced to shift to the control range fa, causing an increase in the output voltage.

In this way, the control is unified by matching a control range for the driving frequency before the discharge lamp is turned on with a control range for the driving frequency when the DC input voltage becomes lower (a variety of advantages can be provided in the ease of circuit designing and the like).

Also, the driving frequency within the control range fa preferably is fixed in the control. Specifically, the frequency is set at a value equal to or higher than famin and equal to or lower than famax. This is effective in simplifying the control, reducing the number of parts and the cost, and the like. A purpose of temporarily reducing the frequency as described above is to maintain the discharge lamp in the lighting state. Therefore, the most simple way is to set the frequency to a fixed value within an allowable range. It has been confirmed in an application to an actual device that the foregoing goal can be achieved without the need for controlling the frequency in real time.

Other implementations are within the scope of the claims.

What is claimed is:

1. A lighting circuit for a discharge lamp comprising a DC-AC converter circuit to receive a DC input voltage and to convert the DC input voltage to an AC voltage and boost the AC voltage, a starter circuit for supplying the discharge lamp with a starting signal, and control means having an input voltage detector circuit for detecting the DC input voltage for controlling power output by said DC-AC converter circuit to perform a lighting control of the discharge lamp, wherein:

said DC-AC converter circuit includes a transformer, a plurality of switching elements, and a resonance capacitor, said switching elements being driven by said control means, said DC-AC converter circuit utilizing a series resonance of said resonance capacitor with an inductance component of said transformer or an inductance element connected to said resonance capacitor, and when said input voltage detector circuit detects the DC input voltage equal to or lower than a predefined threshold, a driving frequency for said switching elements is shifted to a frequency lower than a frequency range when the discharge lamp is turned on to increase a voltage which can be output by said DC-AC converter circuit to maintain the lighting state of the discharge lamp.

2. A lighting circuit for a discharge lamp according to claim 1, wherein:

the threshold associated with the DC input voltage is set to a value higher than the DC input voltage value when the discharge lamp cannot be kept lit at f2, wherein f2 is the driving frequency for said switching elements for a maximum output voltage or maximum output power that can be generated while the discharge lamp is lit.

3. A lighting circuit for a discharge lamp according to claim 1, wherein:

frequencies determined by intersection points of a resonance curve associated with an output voltage applied to the discharge lamp during extinction before the discharge lamp is lit with the maximum output voltage at which the discharge lamp is lit are designated as a first and a second frequency, respectively, wherein the second frequency is higher than the first frequency, and wherein:

when the DC input voltage is equal to or lower than the predefined threshold, the driving frequency for said switching elements is shifted to a frequency range equal to or greater than the first frequency and equal to or lower than the second frequency to increase a voltage which can be output by said DC-AC converter circuit to the maximum output voltage at which the discharge lamp is lit or higher.

4. A lighting circuit for a discharge lamp according to claim 1, wherein:

when the driving frequency for said switching elements is shifted to a frequency lower than the frequency range while the discharge lamp is lit in response to the DC input voltage falling to the predefined threshold or lower, the frequency is within a frequency range defined before the discharge lamp is lit.

5. A lighting circuit for a discharge lamp according to claim 3 wherein:

when the driving frequency for said switching elements is shifted to a frequency lower than the frequency range while the discharge lamp is lit in response to the DC input voltage falling to the predefined threshold or lower, the frequency is set to a fixed value within the frequency range equal to or higher than the first frequency and equal to or lower than the second frequency, or to a fixed value within the frequency range defined before the discharge lamp is lit.

6. A lighting circuit for a discharge lamp according to claim 4 wherein:

when the driving frequency for said switching elements is shifted to a frequency lower than the frequency range while the discharge lamp is lit in response to the DC input voltage falling to the predefined threshold or lower, the frequency is set to a fixed value within the frequency range equal to or higher than the first frequency and equal to or lower than the second frequency, or to a fixed value within the frequency range defined before the discharge lamp is lit.

7. A discharge lamp lighting method for supplying a discharge lamp with an output voltage converted from a DC input voltage to an AC voltage to perform a lighting control of the discharge lamp, said method comprising:

performing a DC-AC conversion using a transformer, a plurality of switching elements, and a resonance capacitor, wherein said switching elements are driven to utilize a series resonance of the resonance capacitor with an inductance component of said transformer or an inductance element connected to said resonance capacitor, and upon detection of the DC input voltage equal to or lower than a predefined threshold, a lighting frequency of the discharge lamp is shifted to a frequency lower than a frequency range when the discharge lamp is lit to maintain the lighting state of the discharge lamp.

* * * * *